US006550992B2

(12) United States Patent
Simmons et al.

(10) Patent No.: US 6,550,992 B2
(45) Date of Patent: Apr. 22, 2003

(54) CORED ROLLER FOR IMAGE FORMING DEVICE

(75) Inventors: Laura Elisabeth Simmons, Corvallis, OR (US); Jonathan Neal Andrews, McMinnville, OR (US); Stephen V. Cooper, Amity, OR (US)

(73) Assignee: Agilent Technologies, Inc., Palo Alto, CA (US)

( * ) Notice: Subject to any disclaimer, the term of this patent is extended or adjusted under 35 U.S.C. 154(b) by 62 days.

(21) Appl. No.: 09/832,607

(22) Filed: Apr. 11, 2001

(65) Prior Publication Data

US 2002/0151421 A1 Oct. 17, 2002

(51) Int. Cl.[7] ..... B41J 7/02; B41J 13/08
(52) U.S. Cl. ..... 400/424; 400/641
(58) Field of Search ..... 400/424, 641, 400/642, 662, 659, 661.1, 661.4; 347/104

(56) References Cited

U.S. PATENT DOCUMENTS

| | | | | |
|---|---|---|---|---|
| 5,363,129 A | | 11/1994 | Kline et al. | 400/637.2 |
| 5,827,160 A | | 10/1998 | Ohki et al. | 492/56 |
| 5,882,131 A | | 3/1999 | Belon et al. | 400/662 |
| 5,932,313 A | | 8/1999 | Barton | 428/141 |
| 6,042,109 A | | 3/2000 | Klausbruckner | 271/225 |
| 6,139,140 A | | 10/2000 | Rasmussen et al. | 347/104 |
| 6,168,269 B1 | | 1/2001 | Rasmussen et al. | 347/102 |

FOREIGN PATENT DOCUMENTS

| | | | | |
|---|---|---|---|---|
| JP | 362011662 A | * | 1/1987 | 400/661.1 |
| JP | 363247074 A | * | 10/1988 | 400/689 |

* cited by examiner

*Primary Examiner*—Huan Tran
*Assistant Examiner*—An H. Do

(57) ABSTRACT

A roller for contacting print media in an image forming device includes a tubular core formed of a first material and having an inner surface and an outer surface, and a sleeve formed of a second material and surrounding a portion of the tubular core. The sleeve includes an inner portion surrounding a portion of the inner surface of the tubular core and an outer portion surrounding a portion of the outer surface of the tubular core. The outer portion of the sleeve has an outer surface for contacting the print media. As such, contact of the print media with the roller is made by the outer portion of the sleeve when the print media is routed through the image forming device.

32 Claims, 5 Drawing Sheets

CORED ROLLER FOR IMAGE FORMING DEVICE

THE FIELD OF THE INVENTION

The present invention relates generally to image forming devices, and more particularly to a roller for routing print media through an image forming device.

BACKGROUND OF THE INVENTION

A conventional image forming device for printing and/or duplicating characters and/or other images onto print media includes one or more print media transport assemblies for routing the print media through a print media path. Typically, the print media transport assemblies each include one or more rollers each mounted on a shaft for contacting the print media and routing the print media through the print media path of the image forming device. Often, the rollers are formed of a solid rubber material.

By forming the rollers of a rubber material, the rollers provide desirable characteristics such as an adequate coefficient of friction, high wear resistance, durability, and ease of manufacture. For example, by forming the rollers of a rubber material, the rollers provide a delicate coefficient of friction which contacts the print media and routes the print media effectively through the image forming device without damage to the print media. In addition, by forming the rollers of a rubber material, the rollers can be formed with conventional molding techniques and easily machined to form concentric rollers.

Unfortunately, forming the rollers of a solid rubber material is relatively expensive. Since each print media transport assembly of the image forming device often includes multiple rollers, the expense of individual rollers is quickly compounded. The total cost of the rollers, therefore, can add significantly to the cost of the image forming device.

Accordingly, a need exists for a roller for use in an image forming device which provides the advantages of a solid rubber roller, yet is less expensive to produce without impacting an ease of manufacturability and/or throughput or print quality of the image forming device.

SUMMARY OF THE INVENTION

One aspect of the present invention provides a roller adapted for contacting print media in an image forming device. The roller includes a tubular core formed of a first material and having an inner surface and an outer surface, and a sleeve formed of a second material and surrounding a portion of the tubular core. The sleeve includes an inner portion surrounding a portion of the inner surface of the tubular core and an outer portion surrounding a portion of the outer surface of the tubular core.

In one embodiment, the second material is a rubber material. In one embodiment, the first material is a plastic material.

In one embodiment, the tubular core has a first end and a second end, wherein the inner portion of the sleeve extends between the first end and the second end of the tubular core. In one embodiment, the outer portion of the sleeve extends between the first end and the second end of the tubular core.

In one embodiment, the outer portion of the sleeve includes a first portion extending from the first end of the tubular core toward the second end of the tubular core and a second portion extending from the second end of the tubular core toward the first end of the tubular core. As such, the first portion and the second portion are spaced axially on the tubular core.

In one embodiment, the inner portion of the sleeve has an inner surface and an outer surface. As such, the outer surface of the inner portion contacts the inner surface of the tubular core.

In one embodiment, the outer portion of the sleeve has an inner surface and an outer surface. As such, the inner surface of the outer portion contacts the outer surface of the tubular core and the outer surface of the outer portion is adapted to contact the print media.

In one embodiment, the tubular core has a first end and a second end, and the sleeve further includes at least one end portion surrounding a portion of at least one of the first end and the second end of the tubular core. In one embodiment, the at least one end portion of the sleeve includes an inner surface and an outer surface. As such, the inner surface of the at least one end portion contacts the at least one of the first end and the second end of the tubular core. In one embodiment, the at least one end portion of the sleeve has a plurality of openings formed therein. As such, the tubular core is accessible through each of the openings.

Another aspect of the present invention provides a method of forming a roller for an image forming device. The method includes providing a tubular core formed of a first material and having an inner surface and an outer surface, and surrounding a portion of the tubular core with a sleeve formed of a second material. Surrounding the tubular core with the sleeve includes surrounding a portion of the inner surface of the tubular core with an inner portion of the sleeve and surrounding a portion of the outer surface of the tubular core with an outer portion of the sleeve.

Another aspect of the present invention provides a print media transport assembly. The print media transport assembly includes a shaft and at least one roller mounted on the shaft. The at least one roller includes a tubular core, an inner sleeve surrounding a portion of an inner surface of the tubular core, and an outer sleeve surrounding a portion of an outer surface of the tubular core. As such, the inner sleeve contacts the shaft. In addition, the tubular core is formed of a first material and the inner sleeve and the outer sleeve are formed of a second material.

Another aspect of the present invention provides an image forming device including at least one print media transport assembly adapted for routing print media therethrough. The at least one print media transport assembly includes a shaft mounted in the image forming device and at least one roller mounted on the shaft. The at least one roller is adapted for contacting the print media and includes a tubular core, an inner sleeve surrounding a portion of an inner surface of the tubular core, and an outer sleeve surrounding a portion of an outer surface of the tubular core. As such, the inner sleeve contacts the shaft and the outer sleeve is adapted for contacting the print media. In addition, the tubular core is formed of a first material and the inner sleeve and the outer sleeve are formed of a second material.

The present invention provides a roller for a print media transport assembly of an image forming device. The roller includes a tubular core and a sleeve of rubber material surrounding the tubular core. As such, the sleeve of rubber material contacts and routes print media through a print media path of the image forming device and frictionally couples the roller to a shaft of the print media transport assembly when mounted thereon.

DESCRIPTION OF THE PREFERRED EMBODIMENTS

In the following detailed description of the preferred embodiments, reference is made to the accompanying drawings which form a part hereof, and in which is shown by way of illustration specific embodiments in which the invention may be practiced. It is to be understood that other embodiments may be utilized and structural or logical changes may be made without departing from the scope of the present invention. The following detailed description, therefore, is not to be taken in a limiting sense, and the scope of the present invention is defined by the appended claims.

Figure 1:
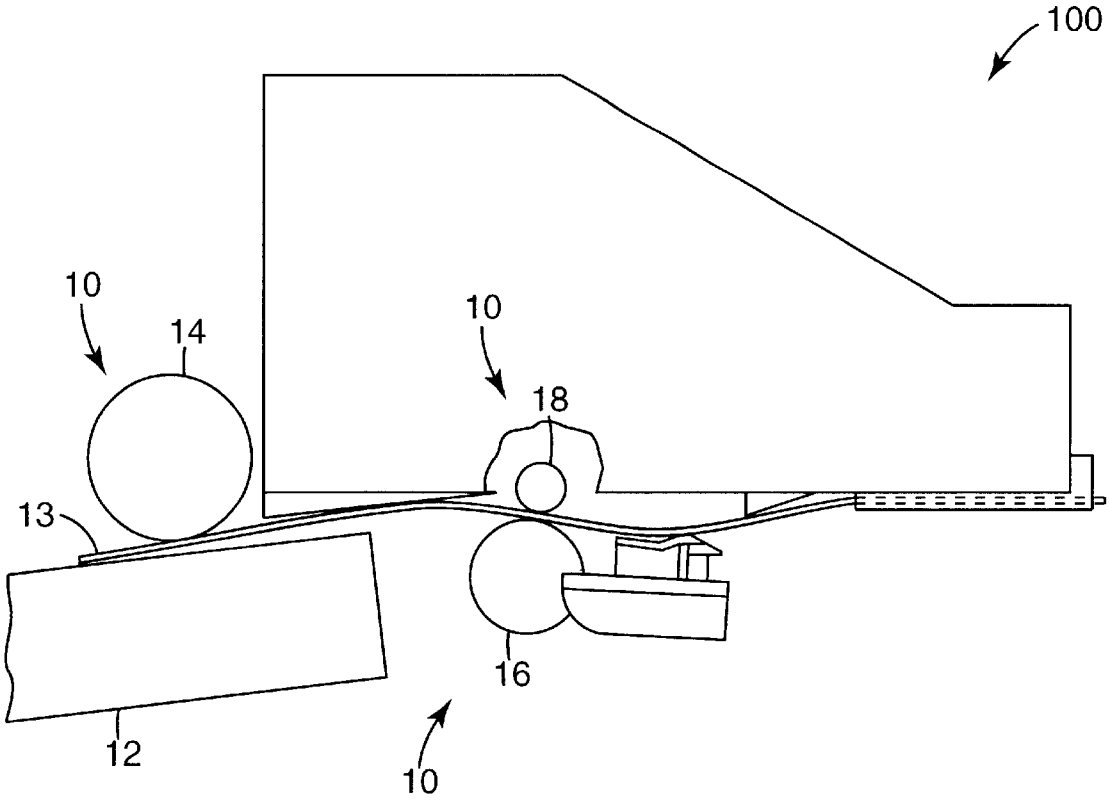
FIG. 1 is schematic illustration of a portion of an image forming device including a print media transport assembly according to the present invention.

FIG. 1 illustrates one embodiment of a portion of an image forming device 100 including at least one print media transport assembly 10 according to the present invention. More specifically, image forming device 100 includes an input paper tray 12, a pick roller assembly 14, a drive roller assembly 16, and a pinch roller assembly 18. Input paper tray 12 holds a supply of paper or other print media 13 such as cardstock, transparencies, Mylar, and the like. As such, pick roller assembly 14 engages a top sheet of print media 13 and routes the top sheet into the nip between drive roller assembly 16 and pinch roller assembly 18. Thus, drive roller assembly 18 advances print media 13 through image forming device 100.

Pick roller assembly 14, drive roller assembly 16, and pinch roller assembly 18 are each one type of embodiment of print media transport assembly 10. Print media transport assembly 10, therefore, moves and/or routes print media 13 through a print media path of image forming device 100. It is to be understood that FIG. 1 is a simplified schematic illustration of image forming device 100 and that image forming device 100 may include, for example, a printing and/or duplicating device such as a printer, photocopier, fax machine, scanner, etc.

Figure 2:
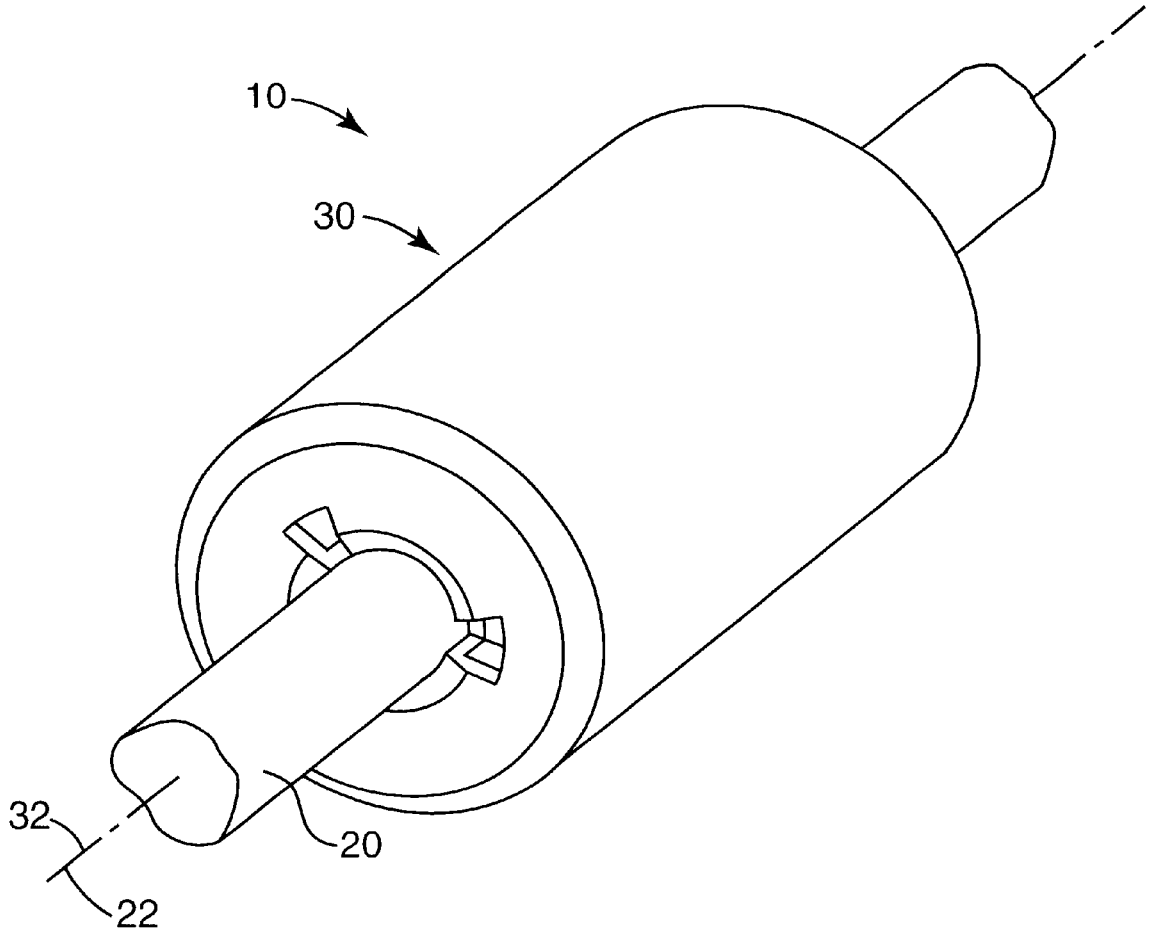
FIG. 2 is a perspective view of a portion of a print media transport assembly including one embodiment of a roller according to the present invention.

FIG. 2 illustrates a portion of one embodiment of print media transport assembly 10. Print media transport assembly 10 includes a shaft 20 and at least one roller 30. Shaft 20 has an axis 22 and, in one embodiment, is rotatably mounted in image forming device 10 for rotation about axis 22. As such, shaft 20 may be a driven shaft and/or an idler shaft. While shaft 20 is illustrated as having a circular cross-section, it is within the scope of the present invention for shaft 20 to have other cross-sections such as a square or other polygonal shape.

Roller 30 is mounted on shaft 20 and has an axis 32 coinciding with axis 22 of shaft 20. In one embodiment, roller 30 is mounted for rotation with shaft 20. As such, roller 30 may be a driven roller and/or an idle roller. While only one roller 30 is illustrated as being mounted on shaft 20, it is understood that multiple rollers 30 may be mounted on shaft 20. As such, rollers 30 may be grouped and/or spaced along shaft 20.

Figure 3:
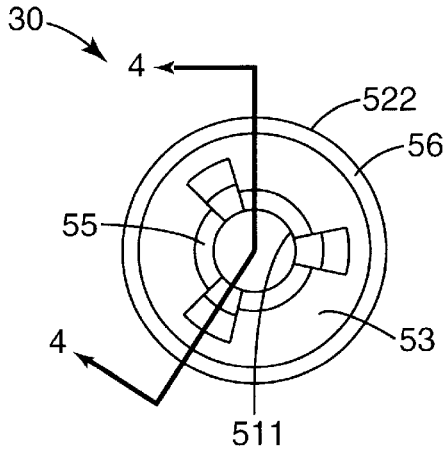
FIG. 3 is an end view of the roller of the print media transport assembly of FIG. 2.
Figure 4:
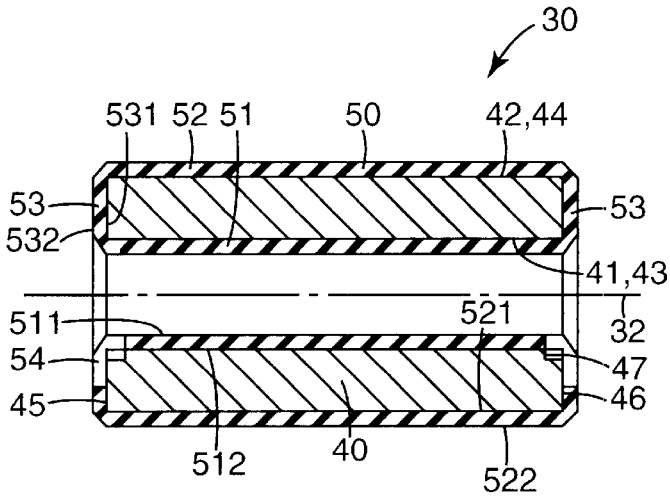
FIG. 4 is a cross-sectional view taken along line 4—4 of FIG. 3.
Figure 5:
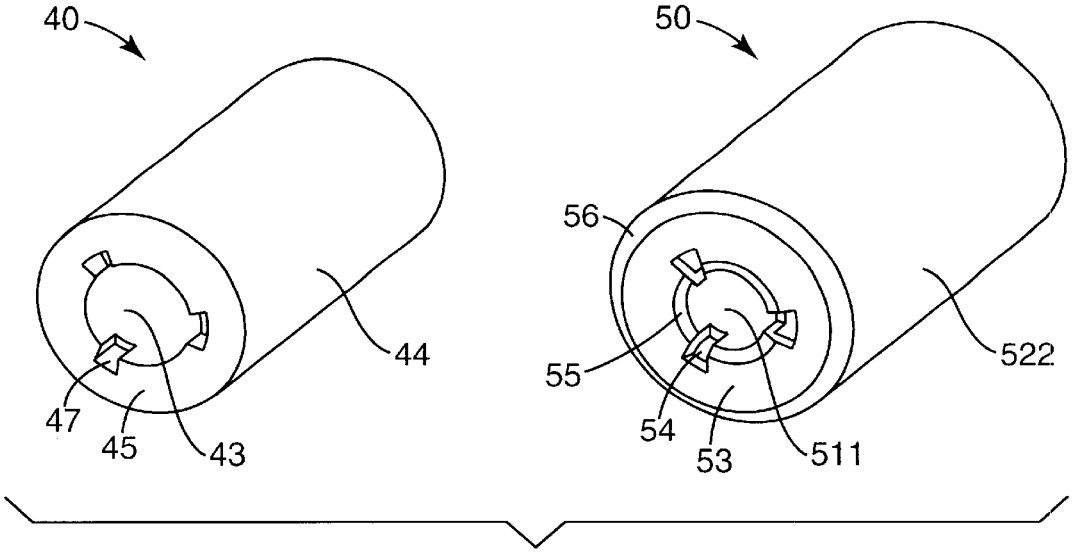
FIG. 5 is a perspective view illustrating a tubular core and a sleeve of the roller of the print media transport assembly of FIG. 2.

Referring to FIGS. 3–5, roller 30 is a cored roller and includes a tubular core 40 and a sleeve 50. Tubular core 40 has an inner diameter 41 and an outer diameter 42 and includes an inner surface 43 at inner diameter 41 and an outer surface 44 at outer diameter 42. In addition, tubular core 40 has a first end 45 and a second end 46. In one embodiment, inner diameter 41 of tubular core 40 is sized so as to accommodate shaft 20. While tubular core 40 is illustrated as being cylindrical and having an annular profile, it is within the scope of the present invention for tubular core 40 to have other profiles including, for example, an elliptical, cam-shaped, or non-concentric profile.

Sleeve 50 is disposed around tubular core 40 so as to surround or cover a portion of tubular core 40. Sleeve 50 includes an inner sleeve portion 51 and an outer sleeve portion 52. As such, inner sleeve portion 51 surrounds a portion of inner surface 43 of tubular core 40 and outer sleeve portion 52 surrounds a portion of outer surface 44 of tubular core 40. Thus, outer sleeve portion 52 is concentric with inner sleeve portion 51. In one embodiment, inner sleeve portion 51 and outer sleeve portion 52 both extend between first end 45 and second end 46 of tubular core 40. Thus, sleeve 50 extends along tubular core 40 between first end 45 and second end 46.

Inner sleeve portion 51 has an inner surface 511 and an outer surface 512. Outer sleeve portion 52 has an inner surface 521 and an outer surface 522. As such, outer surface 512 of inner sleeve portion 51 contacts inner surface 43 of tubular core 40 and inner surface 521 of outer sleeve portion 52 contacts outer surface 44 of tubular core 40.

Preferably, inner surface 511 of inner sleeve portion 51 has a profile corresponding to a profile of shaft 20. In one embodiment, as described above, shaft 20 has a circular cross-section. Thus, inner surface 511 of inner sleeve portion 51 is a cylindrical surface such that inner sleeve portion 51 contacts and mates with shaft 20 when roller 30 is mounted on shaft 20. As described above, however, it is within the scope of the present invention for shaft 20 to have other cross-sectional profiles. Inner surface 511 of inner sleeve portion 51, therefore, is shaped accordingly so as to contact and mate with shaft 20.

In one embodiment, outer surface 44 of tubular core 40 is cylindrical. Thus, inner surface 521 of outer sleeve portion 52 is also cylindrical so as to surround and contact outer surface 44 of tubular core 40. It is, however, within the scope of the present invention for outer surface 44 of tubular core 40 to have other profiles. As such, inner surface 521 of outer sleeve portion 52 has a profile corresponding to a profile of tubular core 40. Inner surface 521 of outer sleeve portion 52, therefore, is shaped accordingly so as to surround and contact outer surface 44 of tubular core 40.

In one embodiment, outer surface 522 of outer sleeve portion 52 is a cylindrical surface. As such, outer surface 522 of outer sleeve portion 52 contacts print media 13 when print media 13 is routed through image forming device 100. Thus, contact of print media 13 with roller 30 is made by sleeve 50. While outer sleeve portion 52 and, therefore, outer surface 522 is illustrated as being cylindrical, it is within the scope of the present invention for outer sleeve portion 52 of sleeve 50 to have an eccentric shape, such as an ellipse or cam-shape. Outer surface 522 of outer portion 52, therefore, forms an eccentric surface.

In one embodiment, sleeve 50 of roller 30 includes a pair of end sleeve portions 53. End sleeve portions 53 cover a portion of first end 45 and a portion of second end 46 of tubular core 40. As such, end sleeve portions 53 each have an inner surface 531 and an outer surface 532. Thus, inner surface 531 of end sleeve portions 53 contacts first end 45 and second end 46 of tubular core 40. Preferably, end sleeve portions 53 are generally annular in shape and are contiguous with and formed integrally with inner sleeve portion 51 and outer sleeve portion 52. It is understood, however, that sleeve 50 may be formed without end sleeve portions 53.

In one embodiment, sleeve 50 is formed of a rubber material. As such, the rubber material of sleeve 50 contacts print media 13 for routing print media 13 through image forming device 100. Rubber material suitable for sleeve 50 includes, for example, polyurethane since polyurethane has been found to have no additives which leave undesirable deposits on paper or other print media.

Preferably, tubular core 40 is formed of a material which is rigid enough to maintain its shape and inexpensive to produce. In one embodiment, tubular core 40 is formed of a plastic material. Plastic material suitable for tubular core 40 includes, for example, polypropylene and nylon. It is, however, within the scope of the present invention for tubular core 40 to be formed of other materials such as aluminum.

Preferably, sleeve 50 is formed around tubular core 40. In one embodiment, sleeve 50 is molded around tubular core 40. To mold sleeve 50 around tubular core 40, tubular core 40 has one or more cavities or notches 47 formed therein which provide points for retention and/or positioning of tubular core 40 while sleeve 50 is molded around tubular core 40. As such, one or more openings 54 corresponding to notches 47 may be formed in sleeve 50 when sleeve 50 is formed.

Openings 54 represent areas where tubular core 40 was retained or held in position by associated portions of the molding equipment while sleeve 50 was molded around tubular core 40. Thus, once sleeve 50 is formed around tubular core 40 and the associated portions of the molding equipment are removed, openings 54 remain. Openings 54, therefore, provide access to tubular core 40.

In one embodiment, notches 47 are provided in first end 45 and second end 46 of tubular core 40. Openings 54, therefore, are formed in end sleeve portions 53 of sleeve 50 when sleeve 50 is formed with end sleeve portions 53. While three notches 47 and, therefore, three openings 54 are illustrated as being formed in tubular core 40 and sleeve 50, respectively, any number of notches 47 and corresponding openings 54 may be provided in tubular core 40 and formed in sleeve 50.

While tubular core 40 is illustrated as having notches 47 formed therein or retention and/or positioning of tubular core 40 while sleeve 50 is molded round tubular core 40, it is within the scope of the present invention for tubular core 40 to be retained and/or positioned during molding of sleeve 50 by a manner other than notches 47. Tubular core 40 may be held or positioned, for example, by simultaneously contacting first end 45 and second end 46 of tubular core 40. Openings 54, however, may still be formed in sleeve 50 when sleeve 50 is molded around tubular core 40 since openings 54 represent areas where tubular core 40 was retained or held in position by associated portions of the molding equipment while sleeve 50 was molded around tubular core 40.

In one embodiment, sleeve 50 includes beveled edges 55 between inner sleeve portion 51 and end sleeve portions 53 and beveled edges 56 between outer sleeve portion 52 and end sleeve portions 53.

Figure 6:
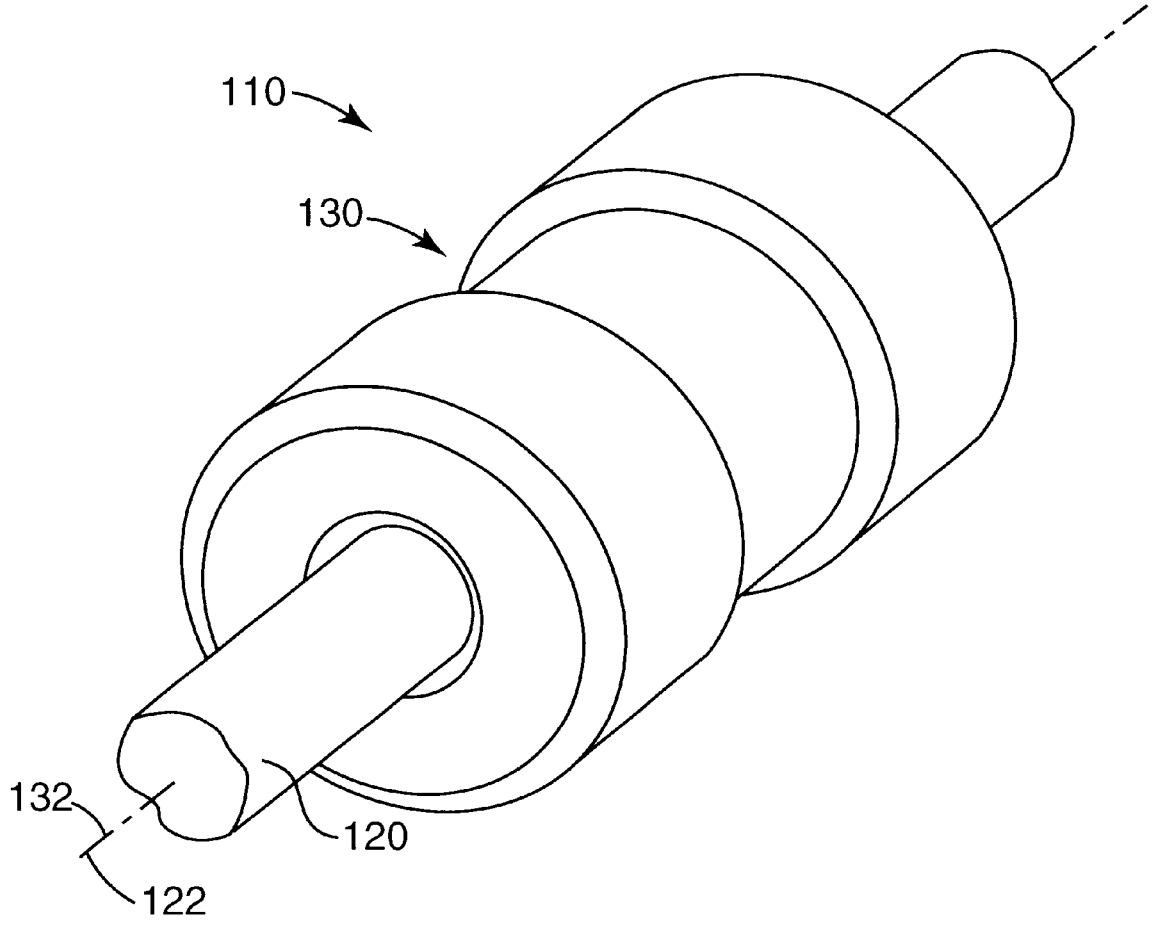
FIG. 6 is a perspective view of a portion of a print media transport assembly including another embodiment of a roller according to the present invention.

FIG. 6 illustrates a portion of another embodiment of print media transport assembly 10. Print media transport assembly 110 includes a shaft 120 and at least one roller 130. Shaft 120 is similar to shaft 20 and includes an axis 122. General descriptions of shaft 20, therefore, are also applicable to shaft 120. Roller 130 is mounted on shaft 120 and has an axis 132 coinciding with axis 122 of shaft 120.

Figure 7:
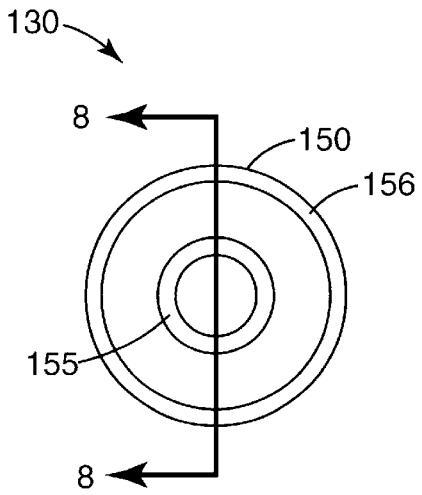
FIG. 7 is an end view of the roller of the print media transport assembly of FIG. 6.
Figure 8:
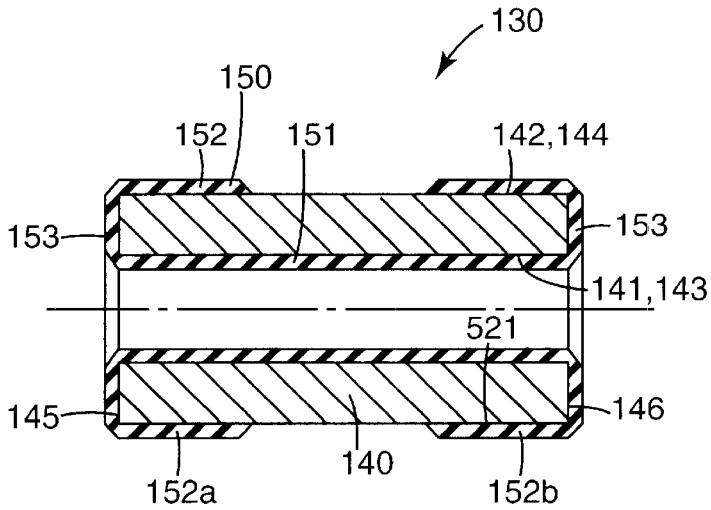
FIG. 8 is a cross-sectional view taken along line 8—8 of FIG. 7.
Figure 9:
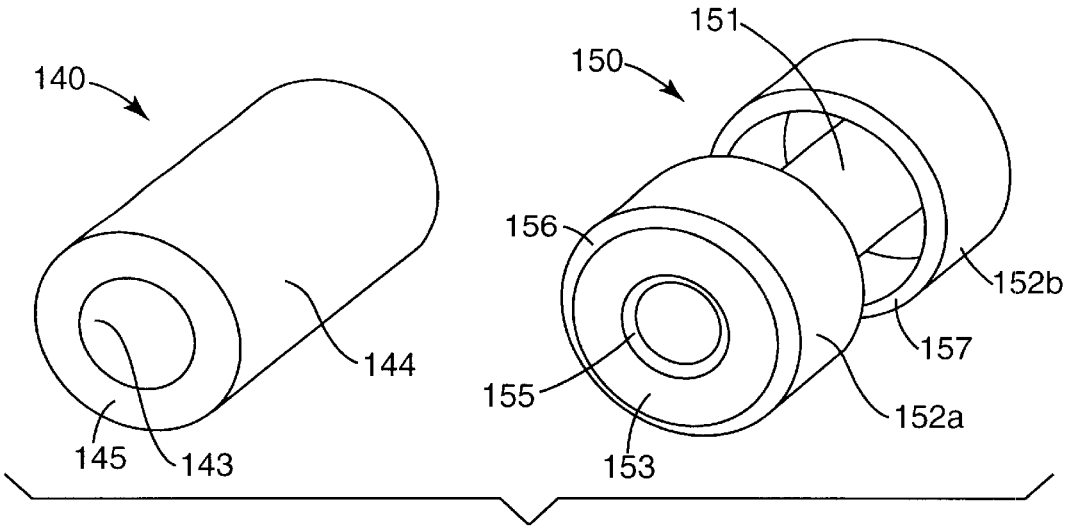
FIG. 9 is a perspective view illustrating a tubular core and a sleeve of the roller of the print media transport assembly of FIG. 6.

Referring to FIGS. 7–9, roller 130 is a cored roller and includes a tubular core 140 and a sleeve 150. Tubular core 140 and sleeve 150 are similar to tubular core 40 and sleeve 50, respectively, except as described below. General descriptions of tubular core 40 and sleeve 50, therefore, are also applicable to tubular core 140 and sleeve 150, respectively.

Tubular core 140, similar to tubular core 40, has an inner diameter 141 and an outer diameter 142 and includes an inner surface 143 at inner diameter 141 and an outer surface 144 at outer diameter 142. In addition, tubular core 140 has a first end 145 and a second end 146.

Sleeve 150, similar to sleeve 50, is disposed around tubular core 140 so as to surround or cover a portion of tubular core 140. Sleeve 150 includes an inner sleeve portion 151 and an outer sleeve portion 152. As such, inner sleeve portion 151 surrounds a portion of inner surface 143 of tubular core 140 and outer sleeve portion 152 surrounds a portion of outer surface 144 of tubular core 140. Thus, outer sleeve portion 152 is concentric with inner sleeve portion 151.

In one embodiment, inner sleeve portion 151 extends between first end 145 and second end 146 of tubular core 140. Thus, sleeve 150 extends along tubular core 140 between first end 145 and second end 146. Outer sleeve portion 152, however, includes a first outer sleeve portion 152*a* and a second outer sleeve portion 152*b*. First outer sleeve portion 152*a* and second outer sleeve portion 152*b*, therefore, are spaced axially on tubular core 140. As such, a portion of tubular core 140 remains exposed between first outer sleeve portion 152*a* and second outer sleeve portion 152*b*. Thus, a portion of tubular core 140 remains exposed between first end 145 and second end 146.

In one embodiment, first outer sleeve portion 152*a* is adjacent first end 145 of tubular core 140 and second outer sleeve portion 152*b* is adjacent second end 146 of tubular core 140. As such, first outer sleeve portion 152*a* extends along tubular core 140 from first end 145 toward second end 146 and second outer sleeve portion 152*b* extends along tubular core 140 from second end 146 toward first end 145. Sleeve 150, therefore, is similar to sleeve 50 with the exception that outer sleeve portion 152 of sleeve 150 includes first outer sleeve portion 152*a* and second outer sleeve portion 152*b*. First outer sleeve portion 152*a* and second outer sleeve portion 152*b*, however, are each similar to outer sleeve portion 52.

In one embodiment, sleeve 150 of roller 130 includes a pair of end sleeve portions 153. End sleeve portions 153 cover a portion of first end 145 and a portion of second end 146 of tubular core 140 in a manner similar to how end sleeve portions 53 cover first end 45 and second end 46 of tubular core 40. Preferably, end sleeve portions 153 are generally annular in shape and are contiguous with and formed integrally with inner sleeve portion 151 and outer sleeve portion 152. More specifically, one end sleeve portion 153 is contiguous with and formed integrally with first outer sleeve portion 152*a* and another end sleeve portion 153 is contiguous with and formed integrally with second outer sleeve portion 152*b*.

Preferably, sleeve 150 and core 140 are formed of a rubber material and a plastic material, respectively, similar to that described above with regards to sleeve 50 and tubular core 40. Thus, to mold sleeve 150 around tubular core 140, tubular core 140 may be held and/or positioned by the portion of tubular core 140 which remains exposed between first end 145 and second end 146 when first outer sleeve portion 152*a* and second outer sleeve portion 152*b* are formed.

In one embodiment, sleeve 150 includes beveled edges 155 between inner sleeve portion 151 and end sleeve portions 153, beveled edges 156 between outer sleeve portions 152*a* and 152*b* and end sleeve portions 153, and beveled edges 157 at ends of outer sleeve portions 152*a* and 152*b* opposite end sleeve portions 153.

By forming roller 30 (including roller 130) with tubular core 40 and sleeve 50 formed of a rubber material, a total cost of roller 30 can be reduced while the advantages of the rubber material for roller 30 are retained. More specifically, by forming roller 30 with tubular core 40 and sleeve 50, the amount of rubber material required for each roller 30 is greatly reduced compared to that required for a comparably-sized solid rubber roller. As such, the cost of producing roller 30 with tubular core 40 and sleeve 50 is reduced since the rubber material is typically more expensive than, for example, the plastic material of tubular core 40. In addition, by forming roller 130 with outer sleeve portions 152*a* and 152*b* spaced axially along tubular core 140, the cost of producing roller 130 is further reduced since the amount of rubber material required for each roller 130 is further reduced. The advantages of the rubber material for roller 130, however, are retained.

By forming roller 30 (including roller 130) with sleeve 50 including inner sleeve portion 51 and outer sleeve portion 52 formed of rubber material, roller 30 offers multiple advantages. For example, the rubber material of inner sleeve portion 51 frictionally couples roller 30 to shaft 20 for rotation with shaft 20 when roller 30 is mounted on shaft 20. Thus, it is not necessary to incorporate additional coupling features, such as knurling of shaft 20, for mounting of roller 30 on shaft 20. In addition, the rubber material of outer sleeve portion 52 can be precision machined using conventional machining techniques to provide roller 30 with a concentric outer surface for contacting print media 13. Furthermore, the rubber material of outer sleeve portion 52 provides roller 30 with a delicate coefficient of friction which moves and/or routes print media 13 through a print media path of image forming device 100 without, for example, misfeeds, multiple feeds, and/or damage to print media 13.

Although specific embodiments have been illustrated and described herein for purposes of description of the preferred embodiment, it will be appreciated by those of ordinary skill in the art that a wide variety of alternate and/or equivalent implementations calculated to achieve the same purposes may be substituted for the specific embodiments shown and described without departing from the scope of the present invention. Those with skill in the chemical, mechanical, electromechanical, electrical, and computer arts will readily appreciate that the present invention may be implemented in a very wide variety of embodiments. This application is intended to cover any adaptations or variations of the preferred embodiments discussed herein. Therefore, it is manifestly intended that this invention be limited only by the claims and the equivalents thereof.

What is claimed is:

1. A roller used for contacting print media in an image forming device, the roller comprising:

a tubular core formed of a first material and having an inner surface and an outer surface; and a sleeve formed of a second material and surrounding a portion of the tubular core, wherein the sleeve includes an inner portion surrounding a portion of the inner surface of the tubular core and an outer portion surrounding a portion of the outer surface of the tubular core.

2. The roller of claim 1, wherein the second material is a rubber material.

3. The roller of claim 2, wherein the first material is a plastic material.

4. The roller of claim 1, wherein the tubular core has a first end and a second end, wherein the inner portion of the sleeve extends between the first end and the second end of the tubular core.

5. The roller of claim 4, wherein the outer portion of the sleeve extends between the first end and the second end of the tubular core.

6. The roller of claim 4, wherein the outer portion of the sleeve includes a first portion extending from the first end of the tubular core toward the second end of the tubular core and a second portion extending from the second end of the tubular core toward the first end of the tubular core, wherein the first portion and the second portion are spaced axially on the tubular core.

7. The roller of claim 1, wherein the inner portion of the sleeve has an inner surface and an outer surface, wherein the outer surface of the inner portion contacts the inner surface of the tubular core.

8. The roller of claim 7, wherein the outer portion of the sleeve has an inner surface and an outer surface, wherein the inner surface of the outer portion contacts the outer surface of the tubular core and the outer surface of the outer portion is used to contact the print media.

9. The roller of claim 1, wherein the tubular core has a first end and a second end, wherein the sleeve further includes at least one end portion surrounding a portion of at least one of the first end and the second end of the tubular core.

10. The roller of claim 9, wherein the at least one end portion of the sleeve includes an inner surface and an outer surface, wherein the inner surface of the at least one end portion contacts the at least one of the first end and the second end of the tubular core.

11. The roller of claim 9, wherein the at least one end portion of the sleeve has a plurality of openings formed therein, wherein the tubular core is accessible through each of the openings.

12. A method of forming a roller for an image forming device, the method comprising the steps of:

providing a tubular core formed of a first material and having an inner surface and an outer surface; and surrounding a portion of the tubular core with a sleeve formed of a second material, including surrounding a portion of the inner surface of the tubular core with an inner portion of the sleeve and surrounding a portion of the outer surface of the tubular core with an outer portion of the sleeve.

13. The method of claim 12, wherein the second material is a rubber material.

14. The method of claim 13, wherein the first material is a plastic material.

15. The method of claim 12, wherein the tubular core has a first end and a second end, wherein surrounding the inner surface of the tubular core includes surrounding the inner surface of the tubular core from the first end to the second end of the tubular core.

16. The method of claim 15, wherein surrounding the outer surface of the tubular core includes surrounding the outer surface of the tubular core from the first end to the second end of the tubular core.

17. The method of claim 15, wherein surrounding the outer surface of the tubular core includes surrounding the outer surface of the tubular core with a first portion and a second portion spaced axially from the first portion.

18. The method of claim 12, wherein the tubular core has a first end and a second end, wherein surrounding the tubular core further includes surrounding a portion of at least one of the first end and the second end of the tubular core with an end portion of the sleeve.

19. The method of claim 18, wherein surrounding the at least one of the first end and the second end of the tubular core includes forming a plurality of openings in the end portion of the sleeve, wherein the tubular core is accessible through each of the openings.

20. A print media transport assembly, comprising:

a shaft; and at least one roller mounted on the shaft the at least one roller including a tubular core, an inner sleeve surrounding a portion of an inner surface of the tubular core, and an outer sleeve surrounding a portion of an outer surface of the tubular core, wherein the tubular core is formed of a first material and the inner sleeve and the outer sleeve are formed of a second material, and wherein the inner sleeve contacts the shaft.

21. The print media transport assembly of claim 20, wherein the second material is a rubber material.

22. The print media transport assembly of claim 21, wherein the first material is a plastic material.

23. The print media transport assembly of claim 20, wherein the roller is mounted for rotation with the shaft.

24. The print media transport assembly of claim 23, wherein the inner sleeve of the roller frictionally couples the roller with the shaft.

25. The print media transport assembly of claim 20, wherein the roller includes an end sleeve surrounding at least one of a first end and a second end of the tubular core, wherein the end sleeve is formed of the second material.

26. The print media transport assembly of claim 25, wherein the end sleeve of the roller is integral with the inner sleeve and the outer sleeve of the roller.

27. The print media transport assembly of claim 20, wherein the outer sleeve of the roller includes a first portion surrounding the outer surface of the tubular core and a second portion surrounding the outer surface of the tubular core, wherein the first portion and the second portion are spaced axially on the tubular core.

28. An image forming device, comprising:

at least one print media transport assembly used for routing print media through the image forming device, wherein the at least one print media transport assembly includes a shaft mounted in the image forming device and at least one roller mounted on the shaft, the at least one roller used for contacting the print media and including a tubular core, an inner sleeve surrounding a portion of an inner surface of the tubular core, and an outer sleeve surrounding a portion of an outer surface of the tubular core, wherein the tubular core is formed of a first material and the inner sleeve and the outer sleeve are formed of a second material, and wherein the inner sleeve contacts the shaft and the outer sleeve is used for contacting the print media.

29. The image forming device of claim 28, wherein the second material is a rubber material.

30. The image forming device of claim 29, wherein the first material is a plastic material.

31. The image forming device of claim 28, wherein the roller is mounted for rotation with the shaft.

32. The image forming device of claim 31, wherein the inner sleeve of the roller frictionally couples the roller with the shaft.

* * * * *